US010487579B2

(12) United States Patent
Rodriguez

(10) Patent No.: US 10,487,579 B2
(45) Date of Patent: Nov. 26, 2019

(54) LADDER RUNG EXTENSION ASSEMBLY

(71) Applicant: Arsenio Rodriguez, Akron, OH (US)

(72) Inventor: Arsenio Rodriguez, Akron, OH (US)

(73) Assignee: INVENT 7, LLC, Akron, OH (US)

( * ) Notice: Subject to any disclaimer, the term of this patent is extended or adjusted under 35 U.S.C. 154(b) by 26 days.

(21) Appl. No.: 15/848,647

(22) Filed: Dec. 20, 2017

(65) Prior Publication Data

US 2019/0186202 A1 Jun. 20, 2019

(51) Int. Cl.
*E06C 7/08* (2006.01)
*E06C 7/16* (2006.01)

(52) U.S. Cl.
CPC ..... *E06C 7/084* (2013.01); *E06C 7/08* (2013.01); *E06C 7/083* (2013.01); *E06C 7/16* (2013.01)

(58) Field of Classification Search
CPC ... E06C 7/08; E06C 7/16; E06C 1/387; E06C 7/084; E06C 7/083
See application file for complete search history.

(56) References Cited

U.S. PATENT DOCUMENTS 407,079 A * 7/1889 Laskey ..... E06C 7/16 182/121
1,174,964 A * 3/1916 Bradley ..... A47C 17/80 5/119
1,578,388 A * 3/1926 Bower ..... E06C 7/16 248/238
1,578,529 A * 3/1926 Kramer ..... E06C 7/16 248/238
1,593,366 A * 7/1926 Singer ..... E06C 7/16 182/121
1,806,502 A * 5/1931 Rosenberg ..... E06C 1/387 182/161
2,680,554 A * 6/1954 Dakin ..... E06C 7/16 182/214
3,029,697 A * 4/1962 Okner ..... G02C 5/22 351/141
3,422,923 A * 1/1969 Lund ..... E06C 7/14 182/120
3,503,468 A * 3/1970 Taylor, Sr. ..... E06C 7/16 182/121
3,708,080 A * 1/1973 Schlei ..... E06C 7/48 182/214
4,121,692 A * 10/1978 Morawski ..... E06C 7/16 182/129
4,241,807 A * 12/1980 McKenna ..... E06C 7/16 182/121

(Continued)

*Primary Examiner* — Catherine A Kelly
*Assistant Examiner* — Shiref M Mekhaeil
(74) *Attorney, Agent, or Firm* — Renner Kenner Law Firm

(57) ABSTRACT

A ladder rung extension assembly includes a bracket assembly including a first pin, a second pin, a pair of mounting assemblies, a pair of first bracket portions extending between the first pin and the second pin, and a pair of angled bracket portions, each of the angled bracket portions extending between the second pin and a respective mounting assembly of the pair of mounting assemblies, a first rung extension assembly having a pivot portion rotatable about the first pin, and a second rung extension assembly having a pivot portion rotatable about the second pin. The ladder rung extension assembly may be engaged with a ladder and have an open position corresponding to the ladder in a deployed position and a closed position corresponding to the ladder in a stored position.

16 Claims, 11 Drawing Sheets

(56) References Cited

U.S. PATENT DOCUMENTS 4,580,660 A * 4/1986 Oling ..... E06C 7/48 182/107
4,586,586 A * 5/1986 Canals ..... E06C 1/12 182/118
4,723,632 A * 2/1988 Gedgoudas ..... E06C 7/48 182/206
4,823,912 A * 4/1989 Gould ..... E06C 7/484 182/107
4,907,673 A * 3/1990 Ginter ..... B63B 27/14 114/362
5,092,427 A * 3/1992 MacMillan ..... B25B 5/04 182/129
5,094,319 A * 3/1992 Kobasic ..... E06C 7/16 182/121
5,279,389 A * 1/1994 Crockett ..... E06C 7/48 182/129
5,358,071 A * 10/1994 Stennett ..... E04D 13/12 182/107
5,460,241 A * 10/1995 LaBelle ..... E06C 7/16 182/121
5,715,908 A * 2/1998 Sager ..... E06C 7/44 182/111
5,722,507 A * 3/1998 Kain ..... E06C 1/393 182/104
5,743,356 A * 4/1998 Mitchell ..... E06C 7/48 182/107
5,911,287 A * 6/1999 Campbell ..... E06C 7/48 182/103
6,109,392 A * 8/2000 Merrick ..... E06C 7/16 182/121
6,347,687 B1 * 2/2002 Alim ..... E06C 1/387 182/159
7,000,732 B1 * 2/2006 Briggs, Jr. ..... B25H 3/00 182/129
7,077,238 B2 * 7/2006 Butler ..... E06C 7/14 182/121
7,114,592 B1 * 10/2006 Gibson ..... E06C 1/39 182/129
7,182,176 B2 * 2/2007 Gibson ..... A47C 12/00 182/129
7,578,371 B2 * 8/2009 Allred, III ..... E04F 11/064 182/163
8,365,863 B2 * 2/2013 Astor ..... E06C 7/14 182/129
8,596,212 B2 * 12/2013 Perkins ..... E06C 1/10 114/362
8,672,279 B2 * 3/2014 Schirmacher ..... E06C 7/14 108/26
9,359,819 B1 * 6/2016 Valadez ..... E06C 7/14
9,488,001 B2 * 11/2016 Cherevko ..... E06C 1/06
9,777,535 B1 * 10/2017 Stentiford, Sr. ..... E06C 7/08
2004/0163890 A1 * 8/2004 Nash, Jr. ..... E06C 7/16 182/122
2006/0006024 A1 * 1/2006 Till ..... E06C 1/39 182/129
2006/0272895 A1 * 12/2006 Lavoie ..... B60R 3/02 182/127
2007/0068732 A1 * 3/2007 Nagle ..... E06C 7/08 182/121
2007/0120028 A1 * 5/2007 Kane ..... E06C 7/14 248/210
2008/0053751 A1 * 3/2008 Meyers ..... E06C 7/16 182/121
2011/0297482 A1 * 12/2011 O'Brien ..... E06C 7/165 182/129
2014/0251728 A1 * 9/2014 Wurth ..... E06C 1/12 182/106
2014/0326538 A1 * 11/2014 Najey ..... E06C 7/08 182/129
2016/0177626 A1 * 6/2016 Miller ..... E06C 7/14 396/419
2016/0376844 A1 * 12/2016 Najey ..... E06C 7/165 182/120
2017/0167198 A1 * 6/2017 Goodnow ..... E06C 7/08
2017/0254145 A1 * 9/2017 Ballard ..... E06C 1/22
2017/0362895 A1 * 12/2017 Simula ..... E06C 7/16
2018/0328110 A1 * 11/2018 Wandschneider ..... E06C 7/14
2018/0355667 A1 * 12/2018 Wang ..... B25H 1/04

* cited by examiner

LADDER RUNG EXTENSION ASSEMBLY

FIELD OF THE INVENTION

The present invention relates to an assembly to extend the depth of one or more rungs of a ladder.

BACKGROUND OF THE INVENTION

Ladders have been used for many years to allow users to reach locations that are otherwise unreachable. Exemplary ladders include step ladders, which generally include a step frame and a support frame connected by a locking mechanism to prevent the ladder from collapsing, and extension ladders, which include a fixed rail and an extension rail generally parallel to one another throughout the length of the ladder. Step ladders may be referred to as A-frame ladders, and are self-supporting ladders, in that they do not need to be leaned against a wall or other structure. Extension ladders are ladders that are conventionally positioned against an elevated surface, such as a wall or the edge of a roof, to support the ladder at a desired angle.

Both step ladders and extension ladders include a plurality of rungs for a user to travel up and down the ladders. Many conventional step ladders and extension ladders include rungs having a depth that is much smaller than the length of a human foot. For example, an exemplary step ladder commonly available at retail stores has a rung depth of only 3 inches. Thus, in a working position, a user of this type of ladder can only fit a portion of his foot on the ladder rungs. Repeated use of this type of ladder may cause one or more foot ailments, such as Achilles tendonitis. Achilles tendonitis is inflammation or irritation of the tendon that attaches to the back of the heel and can be caused by certain forms of activities such as working on a ladder (http://www.footpaincenterofkc.com/common-foot-disorders/).

While certain step ladders include rungs that are themselves closer to the length of a human foot, these step ladders tend to be ones of smaller height. Thus, these ladders would not be suitable for many working purposes, where larger height ladders are required. There remains a need in the art for an assembly to extend the depth of one or more rungs of a ladder.

SUMMARY OF THE INVENTION

In one or more embodiments, the present invention provides a ladder rung extension assembly comprising a bracket assembly including a first pin, a second pin, a pair of mounting assemblies, a pair of first bracket portions extending between the first pin and the second pin, and a pair of angled bracket portions, each of the angled bracket portions extending between the second pin and a respective mounting assembly of the pair of mounting assemblies, a first rung extension assembly having a pivot portion rotatable about the first pin, and a second rung extension assembly having a pivot portion rotatable about the second pin.

In one or more embodiments, the present invention provides a ladder having one or more depth-extended rungs comprising a first pair of ladder legs, a second pair of ladder legs, a first ladder rung positioned between the first pair of ladder legs, a second ladder rung positioned between the first pair of ladder legs and above the first ladder rung, and a ladder rung extension assembly, the ladder rung extension assembly including a bracket assembly including a first pin, a second pin, a pair of mounting assemblies, a pair of first bracket portions extending linearly between the first pin and the second pin, and a pair of angled bracket portions extending between the second pin and a respective mounting assembly of the pair of mounting assemblies, wherein each mounting assembly of the pair of mounting assemblies is coupled with a respective ladder leg of the second pair of ladder legs, a first rung extension assembly having a first extension portion positioned between a first ladder securement securing the first rung extension assembly with the first ladder rung and a first pivot portion adapted to rotate the ladder rung extension assembly, and a second rung extension assembly having a second extension portion positioned between a second ladder securement securing the second rung extension assembly with the second ladder rung and a second pivot portion adapted to rotate the ladder rung extension assembly.

In one or more embodiments, the present invention provides a ladder rung extension assembly comprising a bracket assembly including a first pin, a second pin, a pair of first bracket portions extending linearly between the first pin and the second pin, a pair of downward extending bracket portions extending linearly downward from the first pin, each of the downward extending bracket portions of the pair of downward extending bracket portions including one or more grooves adapted to fit over a securing pin mounted in a leg of a ladder, a first rung extension assembly having a pivot portion rotatable about the first pin, and a second rung extension assembly having a pivot portion rotatable about the second pin.

BRIEF DESCRIPTION OF THE DRAWINGS

Advantages of the present invention will become better understood with regard to the following description, appended claims, and accompanying drawings wherein:

DETAILED DESCRIPTION OF ILLUSTRATIVE EMBODIMENTS

Figure 1:
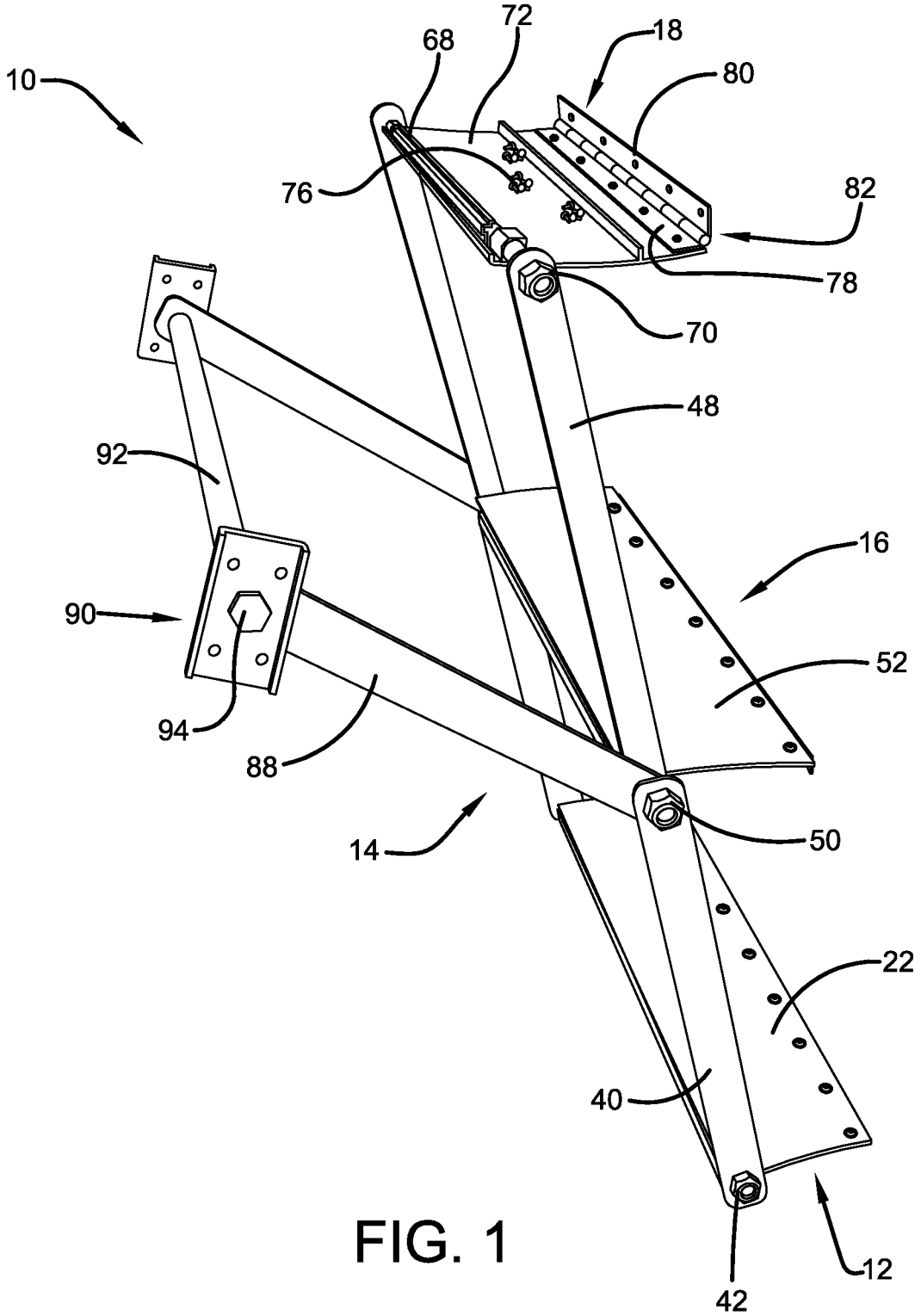
FIG. 1 is a perspective view of a ladder rung extension assembly of one or more embodiments of the invention.
Figure 2:
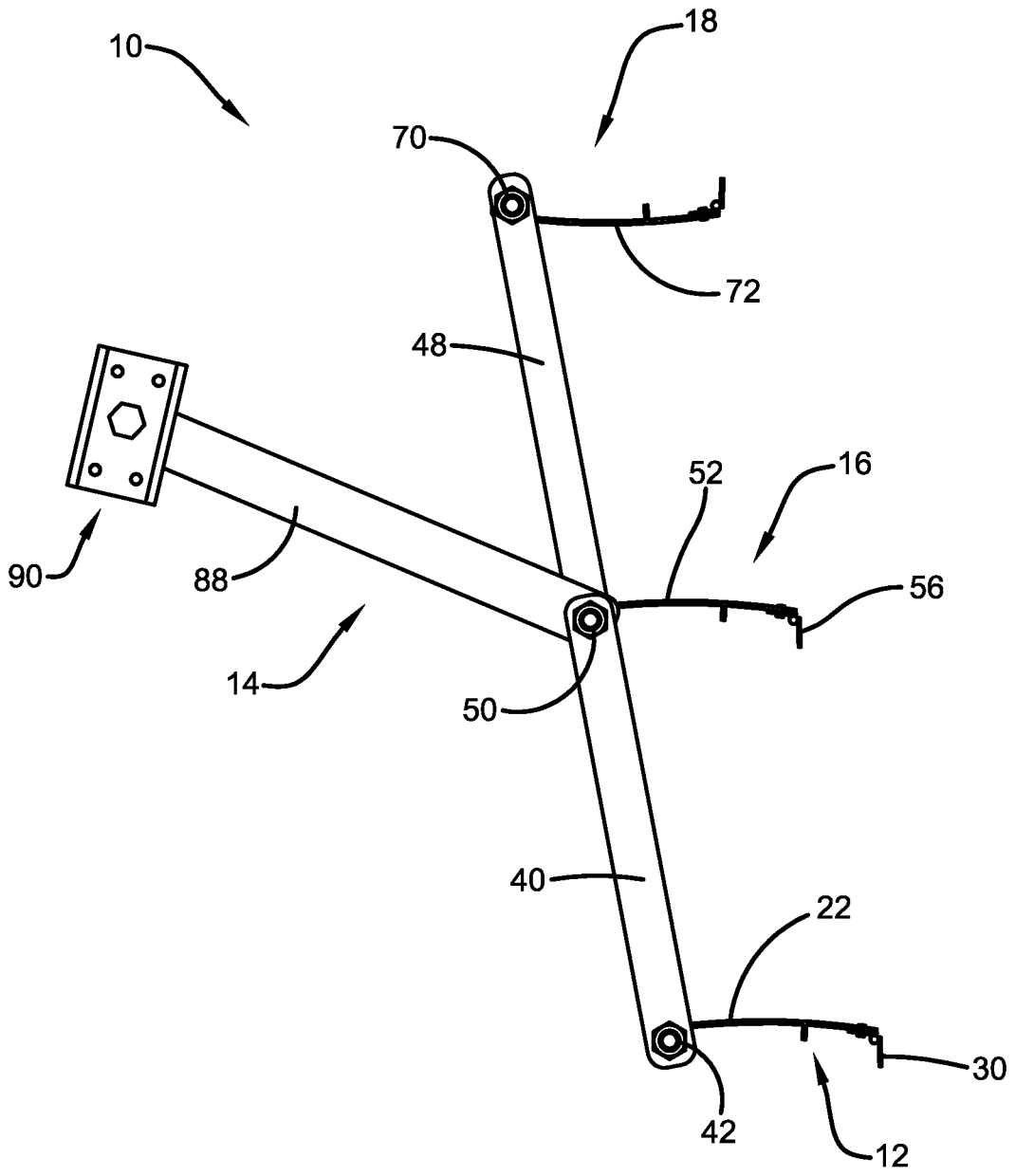
FIG. 2 is a side view of the ladder rung extension assembly of FIG. 1.

With reference to FIG. 1, one or more embodiments of the present invention provide a ladder rung extension assembly 10. Ladder rung extension assembly 10 includes a first rung extension 12 coupled with a bracket assembly 14. Bracket assembly 14 may be further coupled with a second rung extension 16. Bracket assembly 14 may be further coupled with a utility tray 18.

Figure 4:
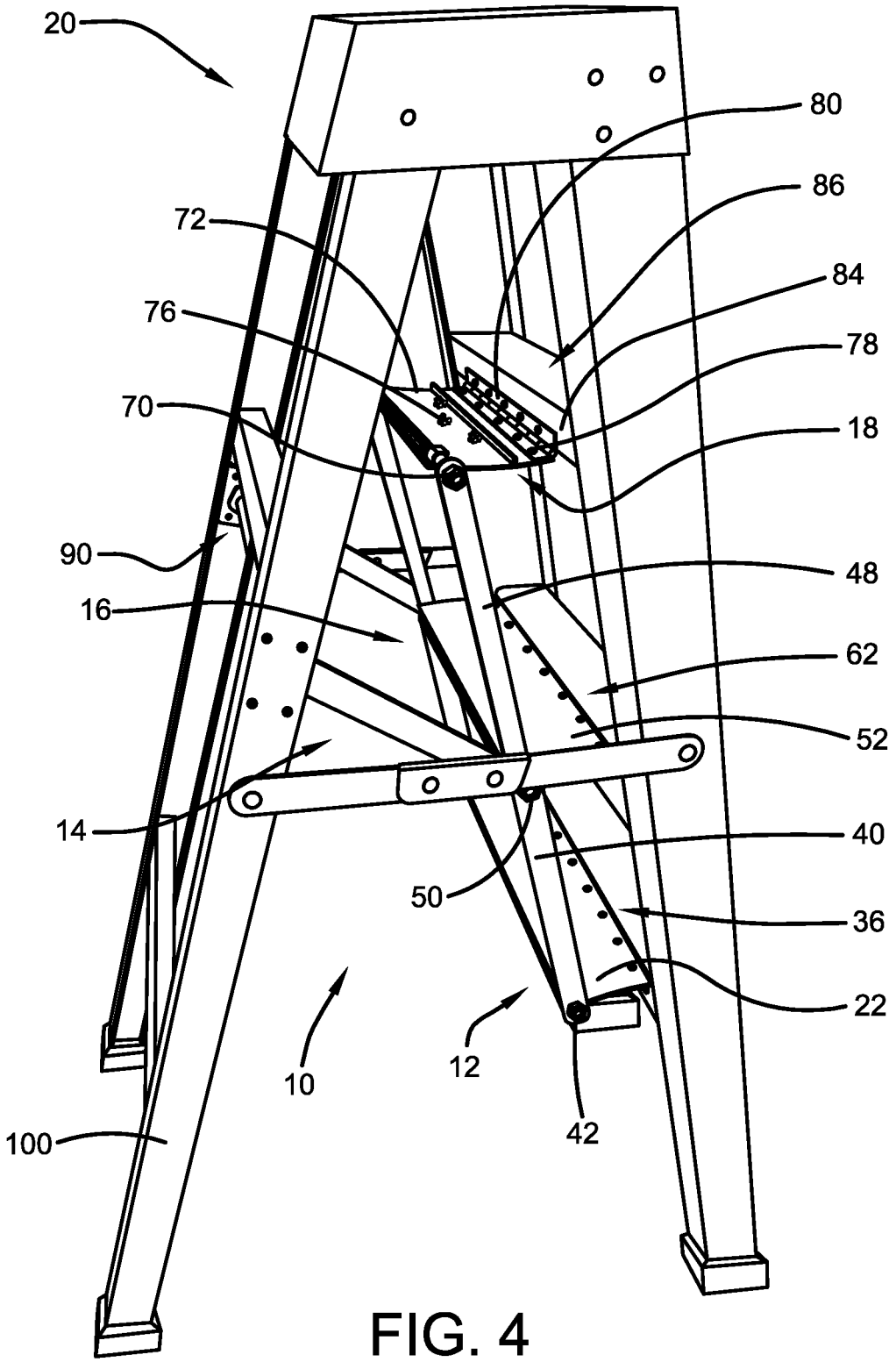
FIG. 4 is a perspective view of a ladder rung extension assembly of this invention, shown coupled with a step ladder in an open position.

As shown in at least FIG. 1 and FIG. 4, ladder rung extension assembly 10 may be characterized as having a first position, which may also be described as a deployed position or open position. The deployed position of ladder rung extension assembly 10 is that position that corresponds with step ladder 20 in a deployed position, when ladder rung extension assembly 10 is coupled with step ladder 20, as shown in FIG. 4. The deployed position of ladder rung extension assembly 10 also corresponds to that position where a user can utilize the rung extensions, such as first rung extension 12 and second rung extension 16.

Figure 9:
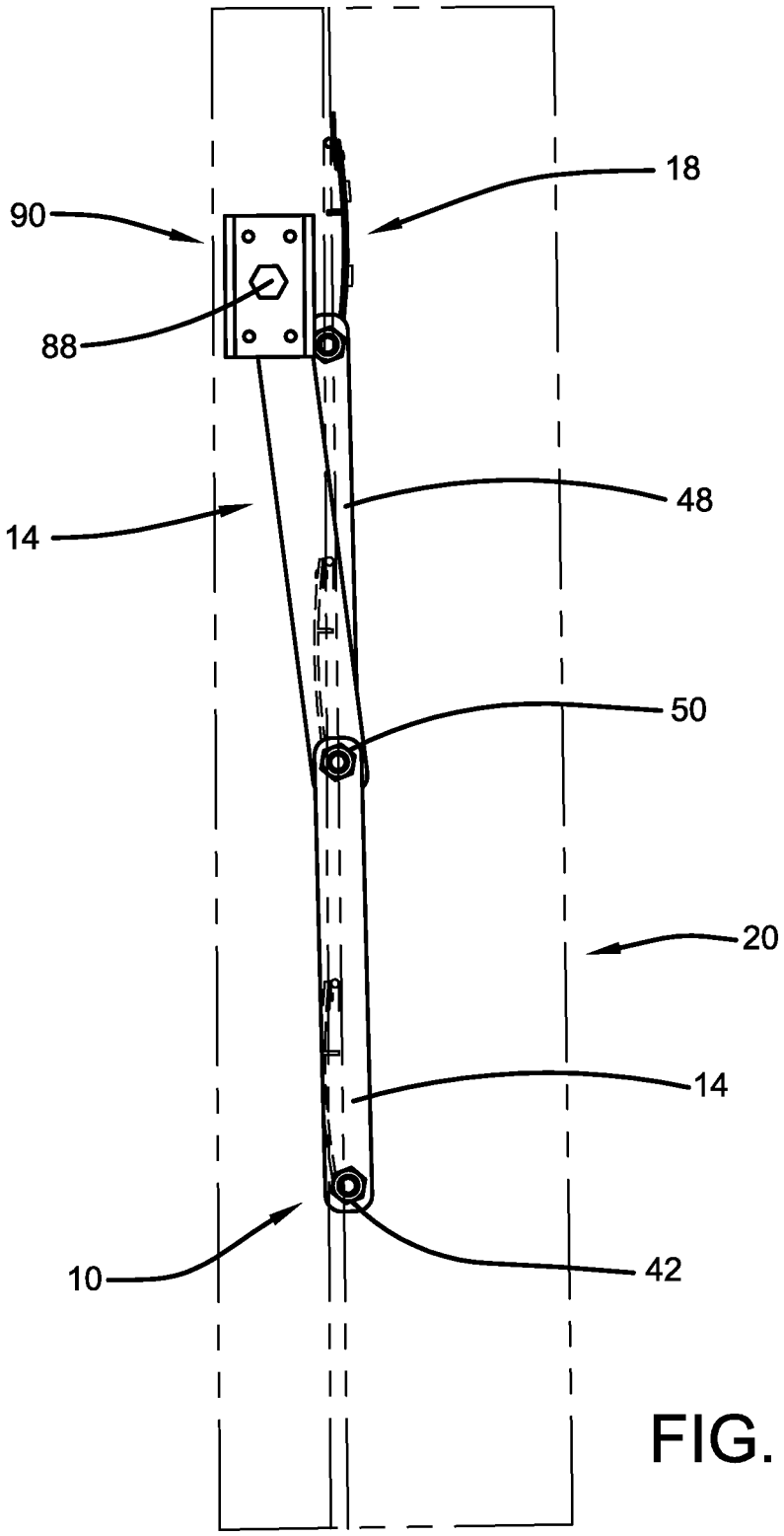
FIG. 9 is a side view of the ladder rung extension assembly of FIG. 4, shown engaged with a step ladder in a closed position.

As shown in at least FIG. 9, ladder rung extension assembly 10 may be characterized as having a second position, which may also be described as a closed position or a stored position. The closed position of ladder rung extension assembly 10 is that position that corresponds with step ladder 20 in a closed position, when ladder rung extension assembly 10 is coupled with step ladder 20, as shown in FIG. 9.

First rung extension 12, which may also be described as a first extension assembly 12, includes an extension portion 22 extending between a ladder securement 32, such as a hinge 32, and a pivot portion 24. Extension portion 22 may be any suitable planar or generally planar component for allowing a user to place his foot thereon when in a deployed position. Pivot portion 24, which may be described as a bracket assembly securement 24, may be any type of connection between extension portion 22 and bracket assembly 14 that allows ladder rung extension assembly 10 to rotate from the deployed position to the stored position, as further described herein. Ladder securement 32 may be any type of connection between extension portion 22 and ladder 20 that allows ladder rung extension assembly 10 to rotate from the deployed position to the stored position, as further described herein.

As shown in the Figures, extension portion 22 may form an upper wall with pivot portion 24 forming a rear wall. The top side of upper wall 22 may include traction features (e.g., ridges and grooves) such as are often found in conventional ladder rungs. In one or more embodiments, the bottom side of upper wall 22 may include a tab on a portion or all of the width of upper wall 22 to provide additional strength to upper wall 22. In one or more embodiments, the tab may be in the shape of an I-beam. In one or more embodiments, the bottom side of upper wall 22 may lack a tab, if upper wall 22 otherwise has sufficient strength.

Rear wall 24 may extend downward from an end of upper wall 22. Rear wall 24 may be a generally semi-cylindrical shape to thereby retain a first pin 26 of bracket assembly 14. Though rear wall 24 is shown in the Figures as having groove portions, rear wall 24 may be formed without groove portions as to form a semi-cylindrical shape. The generally semi-cylindrical shape or semi-cylindrical shape of rear wall 24 allows rear wall 24 to retain first pin 26 of bracket assembly 14 while also allowing ladder rung extension assembly 10 to move between the first position and the second position.

As shown in the Figures, an exemplary ladder securement 32 is a hinge portion 32. Hinge portion 32 of first extension assembly 12 includes a first leaf 28 and a second leaf 30 extending laterally from a knuckle. The knuckle may include a rod inside the knuckle for holding first leaf 28 and second leaf 30 together. As generally known in the art, first leaf 28 and second leaf 30 may provide alternating, interlocking, hollow, circular portions creating the joint of the hinge through which the rod is set. Though an exemplary hinge portion 32 is shown in the Figures, other suitable hinge portions may be generally known to those skilled in the art.

Figure 5:
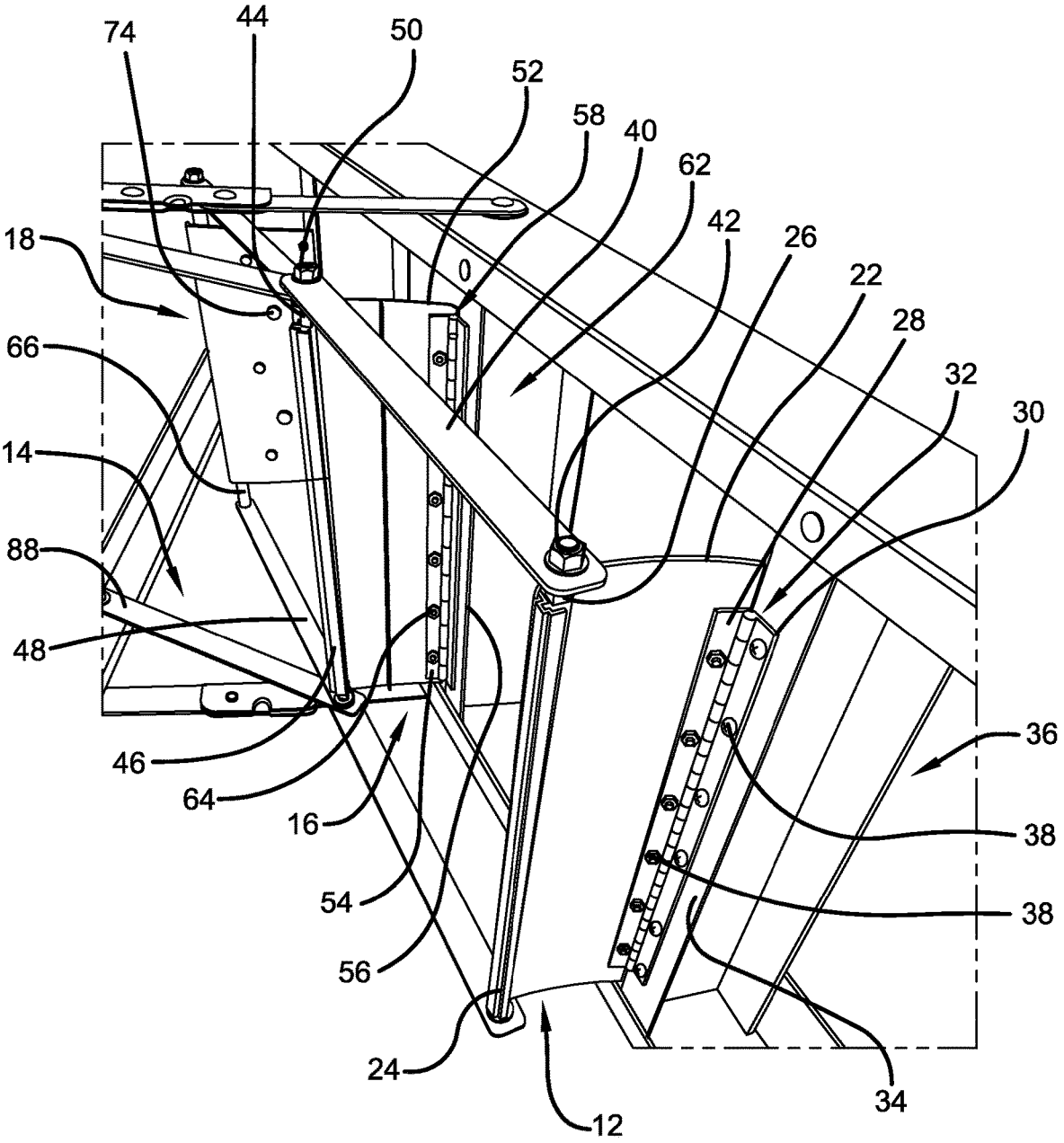
FIG. 5 is a partial perspective view of a ladder rung extension assembly of FIG. 4, shown from an underside of a step ladder.
Figure 6:
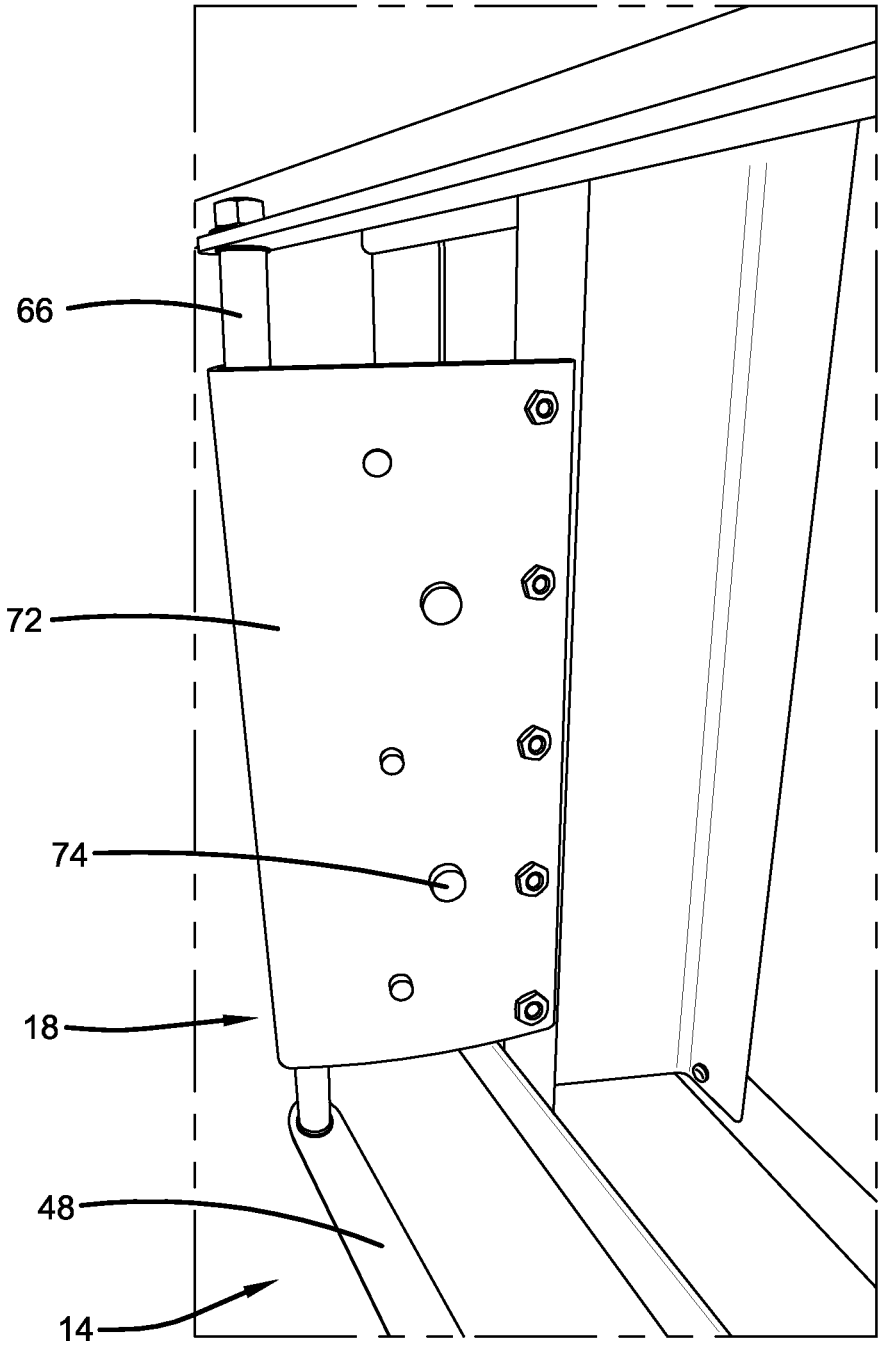
FIG. 6 is a partial perspective view of a utility assembly of the ladder rung extension assembly of FIG. 4, shown from an underside of a step ladder.

First leaf 28 is coupled with the bottom side of upper wall 22. Second leaf 30 is adapted to be coupled with ladder 20. As shown in FIG. 5, second leaf 30 may be coupled with a first side wall 34 of a first ladder rung 36. The coupling of first leaf 28 with the bottom side of upper wall 22 and the coupling of second leaf 30 with a first side wall 34 of a first ladder rung 36 may be by any coupling as generally known in the art. As shown in FIG. 5, this may include screw and nut configurations 38 with screws through holes within first leaf 28 and second leaf 30 and respective holes within the respective components to which they are coupled. In one or more embodiments, the coupling may be welding or another strong adhesive.

As disclosed above, rear wall 24 is adapted to retain first pin 26 of bracket assembly 14. Each end of first pin 26 is positioned through a first hole within a respective first bracket portion 40. A fastening mechanism 42 at each end of first pin 26 is adapted to secure rear wall 24 and first extension assembly 12 between the pair of first bracket portions 40. First extension assembly 12 is able to rotate about first pin 26 in order to move between the first position and the second position of ladder rung extension assembly 10. In one or more embodiments, first pin 26 includes threaded ends and fastening mechanism 42 includes a bolt mated with each threaded end.

In one or more embodiments, the rotation of any component with respect to a second component may be aided by the use of one or more ball bearings, as generally known to those skilled in the art. As an example, first pin 26 may include one or more ball bearings positioned therearound to facilitate the rotation of first extension assembly 12 about first pin. As another example, a ball bearing may be positioned between first pin 26 and the first hole of each first bracket portion 40.

Each first bracket portion 40 extends from first extension assembly 12 toward second extension assembly 16. Each first bracket portion 40 includes a second hole for positioning a second pin 44 therewithin. Second pin 44 is adapted to secure second extension assembly 16, particularly a pivot portion 46 thereof, between a pair of second bracket portions 48 and between the pair of first bracket portions 40. Though second bracket portions 48 are shown in an inward position on second pin 44 with respect to first bracket portions 40, it should be appreciated that first bracket portions 40 may be positioned inward of second bracket portions 48 in certain embodiments.

A fastening mechanism 50 at each end of second pin 44 may be utilized for the securement of second extension assembly 16, second bracket portions 48, and second pin 44. In one or more embodiments, second pin 44 includes threaded ends and fastening mechanism 50 includes a bolt mated with each threaded end. Second extension assembly 16 is able to rotate about second pin 26 in order to move between the first position and the second position of ladder rung extension assembly 10.

Second rung extension 16, which may also be described as a second extension assembly 16, includes an extension portion 52 extending between a ladder securement 58, such as a hinge 58, and pivot portion 46. Extension portion 52 may be any suitable planar or generally planar component for allowing a user to place his foot thereon when in a deployed position. Pivot portion 46, which may be described as a bracket assembly securement 46, may be any type of connection between extension portion 52 and bracket assembly 14 that allows ladder rung extension assembly 10 to rotate from the deployed position to the stored position, as further described herein. Ladder securement 58 may be any type of connection between extension portion 52 and ladder 20 that allows ladder rung extension assembly 10 to rotate from the deployed position to the stored position, as further described herein.

As shown in the Figures, extension portion 52 may form an upper wall with pivot portion 46 forming a rear wall. The top side of upper wall 52 may include traction features (e.g., ridges and grooves) such as are often found in conventional ladder rungs. In one or more embodiments, the bottom side of upper wall 52 may include a tab on a portion or all of the width of upper wall 52 to provide additional strength to upper wall 52. In one or more embodiments, the tab may be in the shape of an I-beam. In one or more embodiments, the bottom side of upper wall 52 may lack a tab, if upper wall 52 otherwise has sufficient strength.

Rear wall 46 may extend downward from an end of upper wall 52. Rear wall 46 may be a generally semi-cylindrical shape to thereby retain second pin 44 of bracket assembly 14. Though rear wall 46 is shown in the Figures as having groove portions, rear wall 46 may be formed without groove portions as to form a semi-cylindrical shape. The generally semi-cylindrical shape or semi-cylindrical shape of rear wall 46 allows rear wall 46 to retain second pin 44 of bracket assembly 14 while also allowing ladder rung extension assembly 10 to move between the first position and the second position.

As shown in the Figures, an exemplary ladder securement 58 is a hinge portion 58. Hinge portion 58 of second extension assembly 16 includes a first leaf 54 and a second leaf 56 extending laterally from a knuckle. The knuckle may include a rod inside the knuckle for holding first leaf 54 and second leaf 56 together. As generally known in the art, first leaf 54 and second leaf 56 may provide alternating, interlocking, hollow, circular portions creating the joint of the hinge through which the rod is set. Though an exemplary hinge portion 58 is shown in the Figures, other hinge portions may be generally known to those skilled in the art.

First leaf 54 is coupled with the bottom side of upper wall 52. Second leaf 56 is adapted to be coupled with ladder 20. As shown in FIG. 5, second leaf 56 may be coupled with a first side wall 60 of a second ladder rung 62. The coupling of first leaf 54 with the bottom side of upper wall 52 and the coupling of second leaf 56 with first side wall 60 of second ladder rung 62 may be by any coupling as generally known in the art. As shown in FIG. 5, this may include screw and nut configurations 64 with screws through holes within first leaf 54 and second leaf 56 and respective holes within the respective components to which they are coupled. In one or more embodiments, the coupling may be welding or another strong adhesive.

Each second bracket portion 48 extends from second extension assembly 16 toward utility assembly 18. Each of second bracket portions 48 generally forms a straight line with the respective first bracket portion 40. Each second bracket portion 48 includes a second hole for positioning a third pin 66 therewithin. Third pin 66 is adapted to secure utility assembly 18, particularly a rear wall 68 thereof, between the pair of second bracket portions 48. A fastening mechanism 70 at each end of third pin 66 may be utilized for the securement of second bracket portions 48 and third pin 66. In one or more embodiments, third pin 66 includes threaded ends and fastening mechanism 70 includes a bolt mated with each threaded end. Utility assembly 18 is able to rotate about third pin 66 in order to move between the first position and the second position of ladder rung extension assembly 10.

Utility tray 18, which may also be described as a utility assembly 18, includes an extension portion 72 extending between a ladder securement 82, such as a hinge 82, and a pivot portion 68. Extension portion 72 may be any suitable planar or generally planar component for allowing a user to place one or more tools thereon when in a deployed position. Pivot portion 68, which may be described as a bracket assembly securement 68, may be any type of connection between extension portion 72 and bracket assembly 14 that allows ladder rung extension assembly 10 to rotate from the deployed position to the stored position, as further described herein. Ladder securement 82 may be any type of connection between extension portion 72 and ladder 20 that allows ladder rung extension assembly 10 to rotate from the deployed position to the stored position, as further described herein.

As shown in the Figures, extension portion 72 may form a lower wall with pivot portion 68 forming a rear wall. The bottom side of lower wall 72 may include one or more magnets 74 coupled therewith. One or more magnets 74 may be secured to the bottom side of lower wall 72 by an adhesive or any other generally known securement. The one or more magnets 74 may be provided so that magnetic work pieces 76, such as wire, nails, or screws, will be retained on the top side of lower wall 72 for a ladder user to utilize. In one or more embodiments, one side of lower wall 72 may include a tab on a portion or all of the width of upper wall 72 to provide additional strength to lower wall 72. In one or more embodiments, the tab may be in the shape of an I-beam. In one or more embodiments, lower wall 72 may lack a tab, if lower wall 72 otherwise has sufficient strength.

Rear wall 68 may extend upward from an end of lower wall 72. Rear wall 68 may be a generally semi-cylindrical shape to thereby retain third pin 66 of bracket assembly 14. Though rear wall 68 is shown in the Figures as having groove portions, rear wall 68 may be formed without groove portions as to form a semi-cylindrical shape. The generally semi-cylindrical shape or semi-cylindrical shape of rear wall 68 allows rear wall 68 to retain third pin 66 of bracket assembly 14 while also allowing ladder rung extension assembly 10 to move between the first position and the second position.

Hinge portion 82 of utility assembly 18 includes a first leaf 78 and a second leaf 80 extending laterally from a knuckle. The knuckle may include a rod inside the knuckle for holding first leaf 78 and second leaf 80 together. As generally known in the art, first leaf 78 and second leaf 80 may provide alternating, interlocking, hollow, circular portions creating the joint of the hinge through which the rod is set. Though an exemplary hinge portion 82 is shown in the Figures, other hinge portions may be generally known to those skilled in the art. Though hinge portion 82 of utility assembly 18 is shown on the top side of lower wall 72, it should be appreciated hinge portion 82 could also be positioned on the bottoms side of lower wall 72, with the length of second bracket portion 48 extended so that second leaf 80 corresponds with the appropriate position.

As shown in FIG. 4, first leaf 78 is coupled with the top side of lower wall 72. Second leaf 80 is adapted to be coupled with ladder 20. As shown in FIG. 4, second leaf 80 may be coupled with a first side wall 84 of a third ladder rung 86. The coupling of first leaf 78 with the top side of lower wall 72 and the coupling of second leaf 80 with first side wall 84 of a third ladder rung 86 may be by any coupling as generally known in the art. As shown in FIG. 4, this may include screw and nut configurations 86 with screws through holes within first leaf 78 and second leaf 80 and respective holes within the respective components to which they are coupled. In one or more embodiments, the coupling may be welding or another strong adhesive.

As disclosed above, second pin 44 and fastening mechanism 50 at each end thereof secure second extension assembly 16, a first end of each first bracket portion 40, and a first end of each second bracket portion 48. Second pin 44 and fastening mechanism 50 at each end thereof also secure a pair of angled bracket portions 88 at a first end of each angled bracket portion 88. Though the first ends of bracket portions 88 are shown positioned between the respective first bracket portion 40 and second bracket portion 48, it should be appreciated that angled bracket portions 88, first bracket portions 40, and second bracket portion 48 may take any suitable position on second pin 44.

Each angled bracket portion 88 extends from second extension assembly 16 toward a respective mounting assembly 90. Each angled bracket portion 88 includes a second hole for positioning a mounting pin 92 therewithin. Mounting pin 92 is adapted to secure second ends of angled bracket portions 88 between a pair of mounting assemblies 90. A fastening mechanism 94, such as bolt 94, at each end of mounting pin 92 may be utilized for the securement of angled bracket portion 88 and mounting assemblies 90. Further securement mechanisms 96, such as bolts 96, may be utilized for additional securement of mounting pin 92 with respect to mounting assemblies 90. Each angled bracket portion 88 is able to rotate about mounting pin 92 in order to move between the first position and the second position of ladder rung extension assembly 10.

In one or more embodiments, angled bracket portions 88 may be characterized by the angle formed with first bracket portions 40 and second bracket portions 48. In one or more embodiments, angled bracket portions 88 in the open position of ladder rung extension assembly 10 may form an angle in the range of 100 degrees to 150 degrees with respect to the respective first bracket portion 40 (that is, 30 degree to 80 degrees with respect to second bracket portion 48), in other embodiments, 110 degrees to 140 degrees with respect to the respective first bracket portion 40, in other embodiments, 120 degrees to 130 degrees with respect to the respective first bracket portion 40, in other embodiments, 123 degrees to 127 degrees with respect to the respective first bracket portion 40. In one or more embodiments, angled bracket portions 88 may form an angle of 125 degrees, or approximate thereto, with respect to the respective first bracket portion 40.

Each mounting assembly 90 includes a support block 98, which may also be described as a bracket mount 98 or a mounting device 98, having one or more holes therein. A hole generally centrally located in support block 98 is adapted to receive a respective end of mounting pin 92. Additional holes in support block 98 may be provided to secure bracket mount 98 to a leg 100 of ladder 20 by way of screw and nut configurations 102 with screws through holes within support block 98 and the leg of ladder 20. In these or other embodiments, support block 98 may be secured to the leg of ladder 20 by welding or another strong adhesive.

Figure 7:
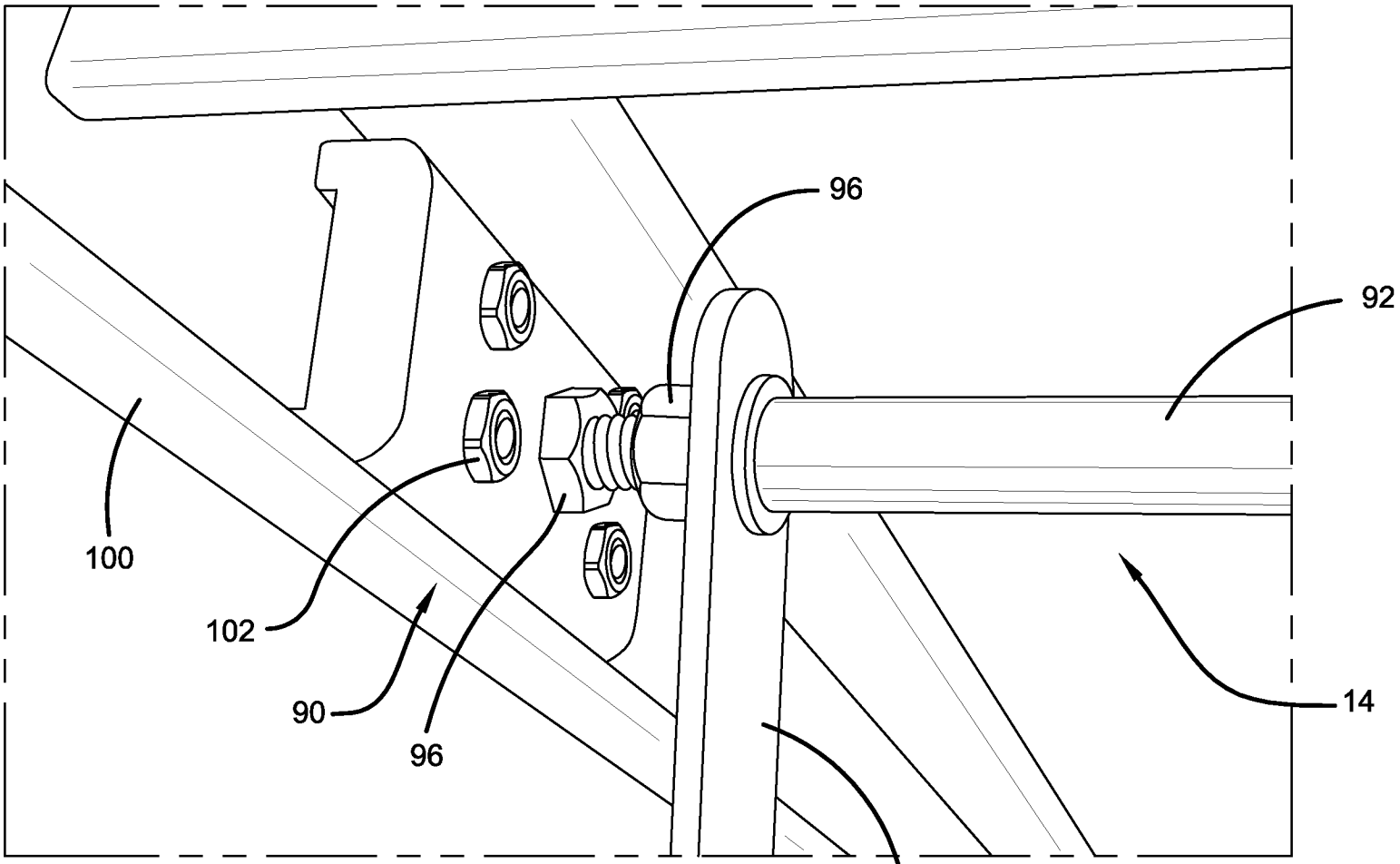
FIG. 7 is a partial perspective view of a support block of the ladder rung extension assembly of FIG. 4, with the support block shown secured to a step ladder.

In one or more embodiments, as shown in FIG. 7, support block 98 may include a curved surface for an end positioned away from the leg of ladder 20. In these or other embodiments, as shown in FIG. 7, support block 98 may include a channel within an end positioned proximate the leg of ladder 20. In one or more embodiments, support block 98 may be shaped as a rectangular prism. In one or more embodiments, support block 98 is adapted to fit within the sidewall configuration of the leg of ladder 20. In embodiments where a ladder lacks sidewalls, support block 98 may be adapted to simply be secured to the leg of a ladder.

Figure 3:
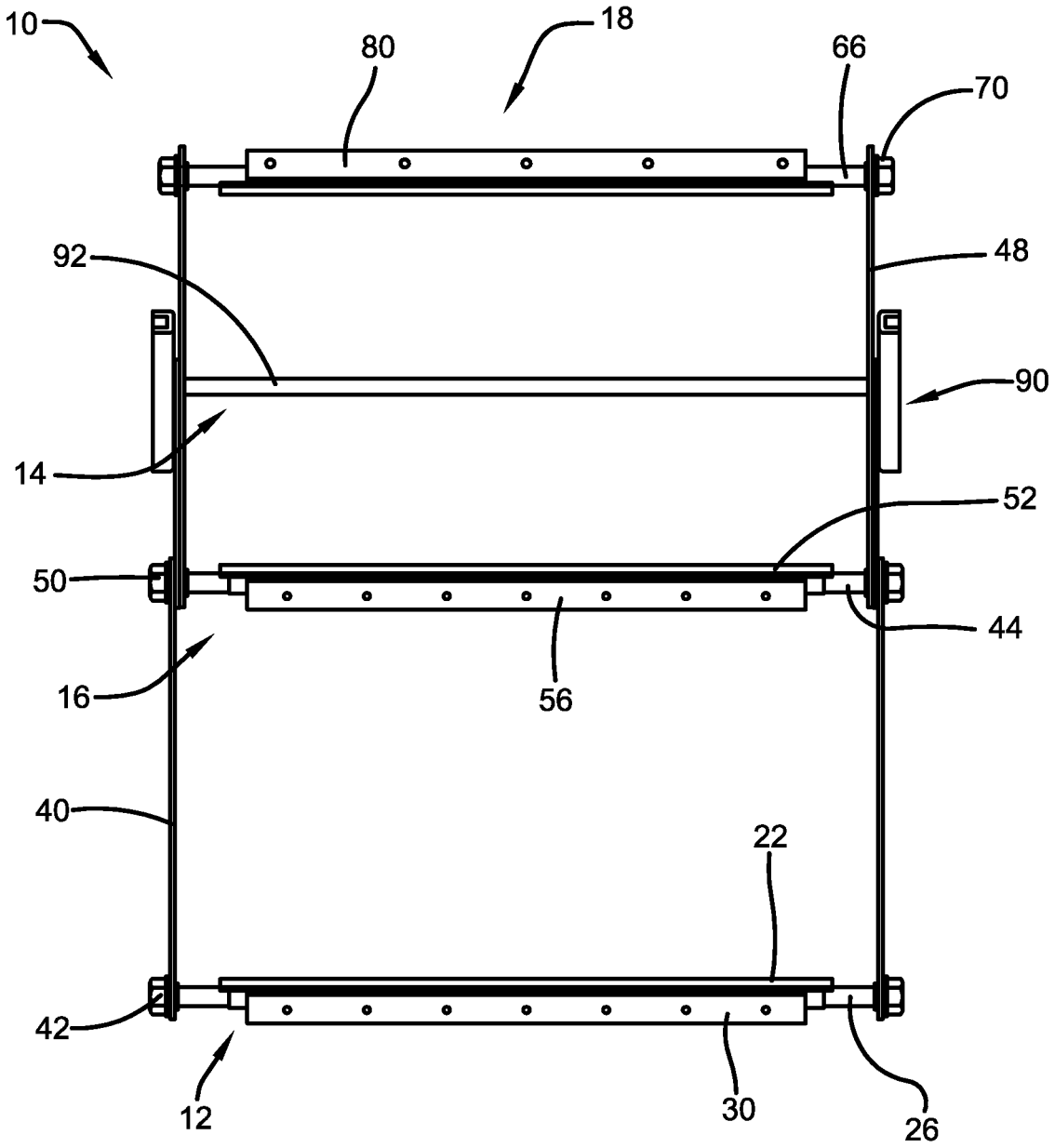
FIG. 3 is a front view of the ladder rung extension assembly of FIG. 1.
Figure 8:
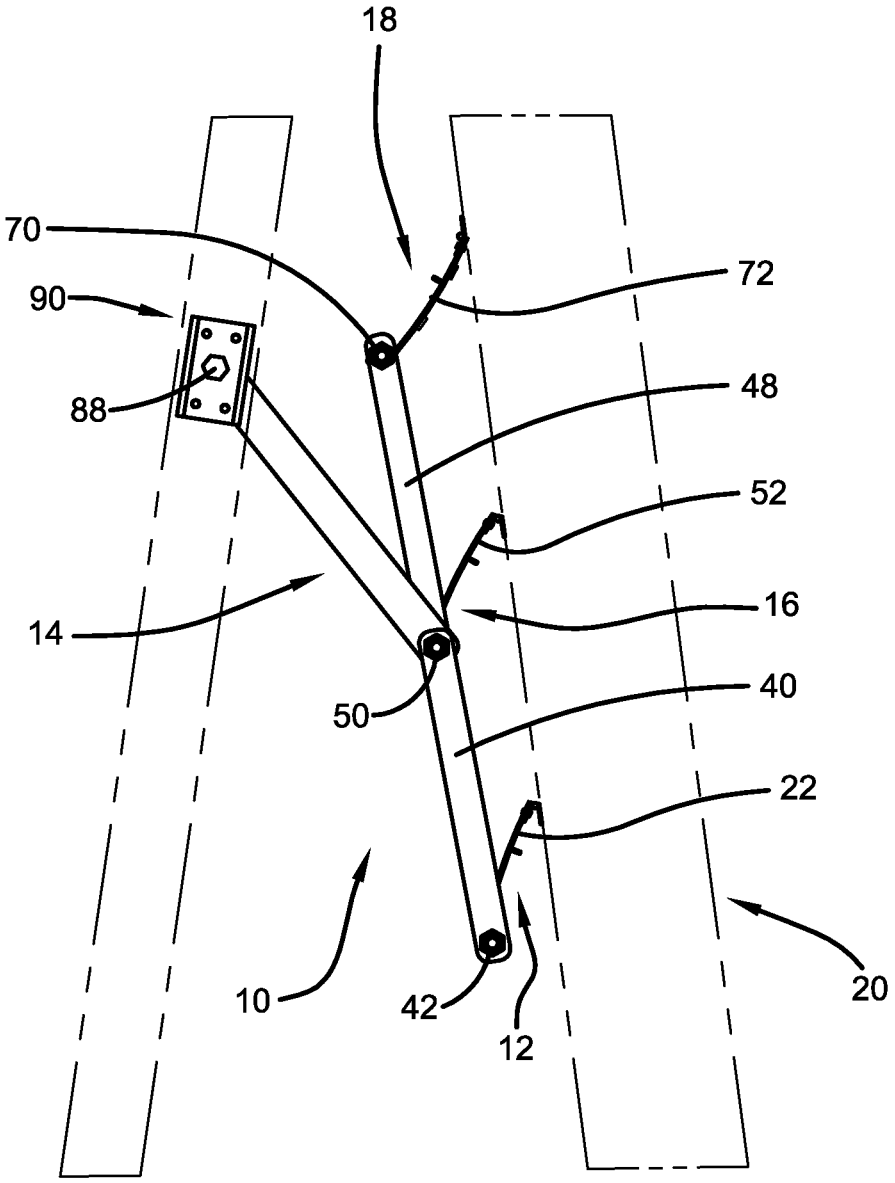
FIG. 8 is a side view of the ladder rung extension assembly of FIG. 4, shown engaged with a step ladder in a partially open position.

Angled bracket portions 88 are of a length and angle such that ladder 20 having ladder rung extension assembly 10 can move between the open position and the closed position. Therefore, mounting assemblies 90 are also capable of being mounted at a location on the respective leg of ladder 20, such that ladder 20 having ladder rung extension assembly 10 can move between the open position and the closed position. When moving between the open position and the closed position of ladder 20, the respective components of ladder rung extension assembly 10 are able to rotate about the respective pins. As seen at least in FIG. 3, FIG. 8, and FIG. 9, during the transition between the open position and the closed position of ladder 20, none of the components of ladder rung extension assembly 10 interfere with travel between the open position and the closed position. Thus, ladder rung extension assembly 10 may be placed on an existing conventional step ladder, that is, subsequent to the manufacture and purchase of the conventional step ladder, without modification to the conventional step ladder other than steps necessary for the addition of ladder rung extension assembly 10. In other embodiments, ladder rung extension assembly 10 may be placed on a step ladder as part of the manufacturing process.

As generally known to those skilled in the art, components of ladder rung extension assembly 10 may be made be made of any suitable material. Exemplary materials include metal, wood, fiberglass, and tough plastic. In one or more embodiments, all components of ladder rung extension assembly 10 are metal. In other embodiments, different components of ladder rung extension assembly 10 may be made from different materials.

For adding ladder rung extension assembly 10 to ladder 20, certain steps may be taken to ease the addition. For example, as disclosed above, one or more embodiments include screw and nut configurations to secure the second leaf of a hinge portion with a ladder rung. Thus, the addition of ladder rung extension assembly 10 to ladder 20 may benefit from providing pilot holes within the first side walls of the ladder rungs. Similarly, the addition of ladder rung extension assembly 10 to ladder 20 may benefit from providing pilot holes within the legs for the securement of mounting assemblies 90. Where a user may add ladder rung extension assembly 10 to an already-purchased ladder 20, ladder rung extension assembly 10 may be accompanied with particular instructions for drilling pilot holes in predetermined locations. Or, the pilot holes may be drilled by the user as desired for a particular type of ladder 20.

In connection with use on ladder 20, first extension assembly 12 is adapted to serve the function of extending the depth of first ladder rung 36 such that a user may stand more comfortably on the combination of first extension assembly 12 and first ladder rung 36. Similarly, second extension assembly 16 is adapted to serve the function of extending the depth of second ladder rung 62 such that a user may stand more comfortably on the combination of second extension assembly 16 and second ladder rung 62. Second extension assembly 16 and second ladder rung 62 may be said to provide a second extended option on which a user may stand.

Figure 10:
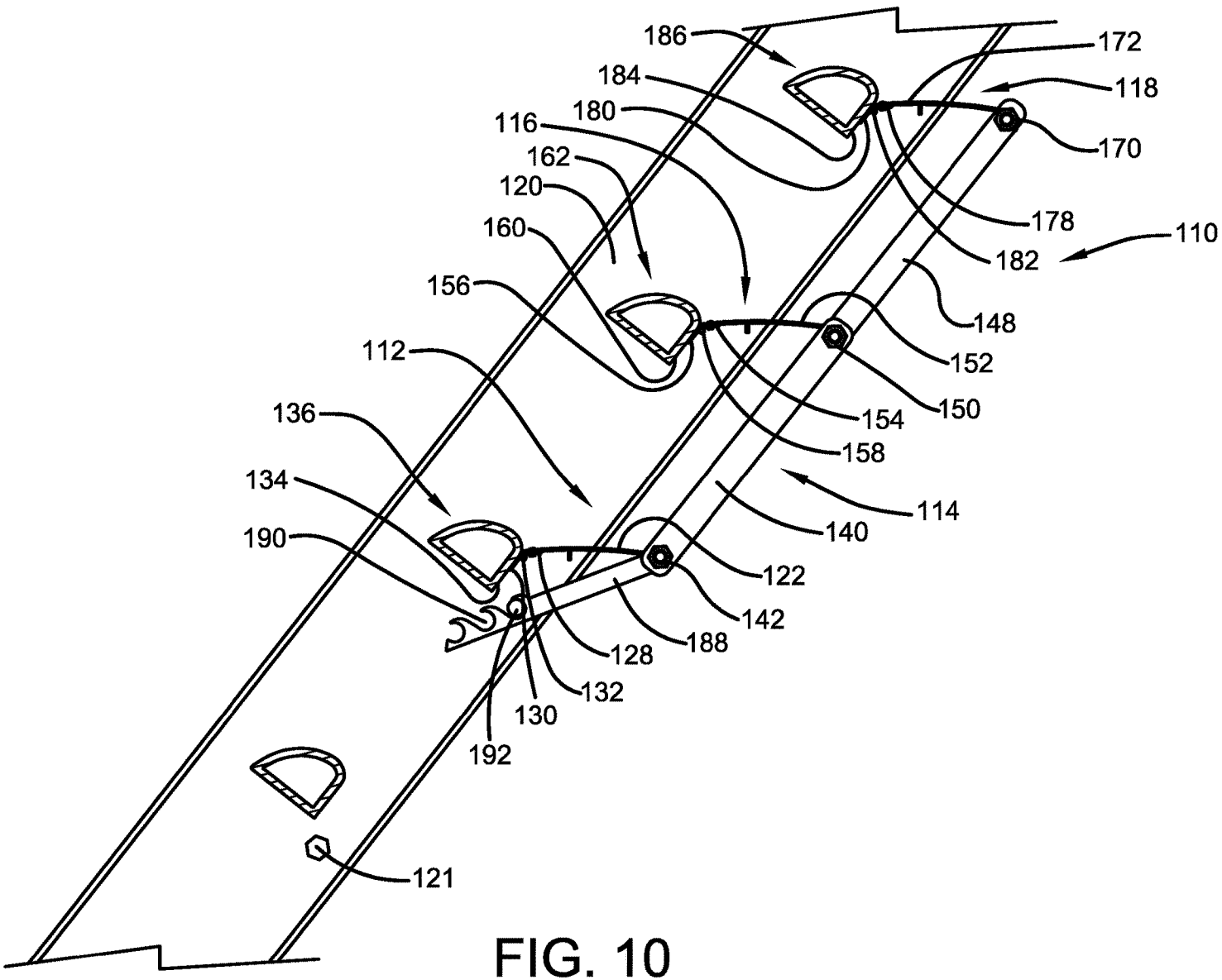
FIG. 10 is a side view of a ladder rung extension assembly of one or more embodiments of the invention coupled with an extension ladder, with the assembly in an open position.

With reference to FIG. 10, one or more embodiments of the present invention provide a ladder rung extension assembly 110. Ladder rung extension assembly 110 includes a first rung extension 112 coupled with a bracket assembly 114. Bracket assembly 114 may be further coupled with a second rung extension 116. Bracket assembly 114 may be further coupled with a third rung extension 118.

Though ladder rung extension assembly 110 is described further herein below, it should be appreciated that ladder rung extension assembly 110 is similar to ladder rung extension assembly 10 in certain aspects. That is, ladder rung extension assembly 110 is only shown in the Figures from a side view, but it should be appreciated that first rung extension 112 is similar to first rung extension 12 and second rung extension 116 is similar to second rung extension 16. Also, third rung extension 118 is similar to utility tray 18 except that third rung extension 118 is flipped compared to utility tray 18. It should also be appreciated that bracket assembly 114 couples together first rung extension 112, second rung extension 116, and third rung extension in a similar manner as bracket assembly 14 couples together first rung extension 12, second rung extension 16, and utility tray 18. As discussed further herein, one difference between ladder rung extension assembly 110 ladder rung extension assembly 10 is that ladder rung extension assembly 10 includes angled bracket portions 88 whereas ladder rung extension assembly 110 includes downward extending bracket portions that may be secured in place by mounting bolts 121.

As shown in FIG. 10, ladder rung extension assembly 110 may be characterized as having a first position, which may also be described as a deployed position or open position. The deployed position of ladder rung extension assembly 110 is that position that corresponds with a user being capable of utilizing the ladder rung extension assembly 110, when ladder rung extension assembly 110 is coupled with extension ladder 120, as shown in FIG. 10.

Figure 11:
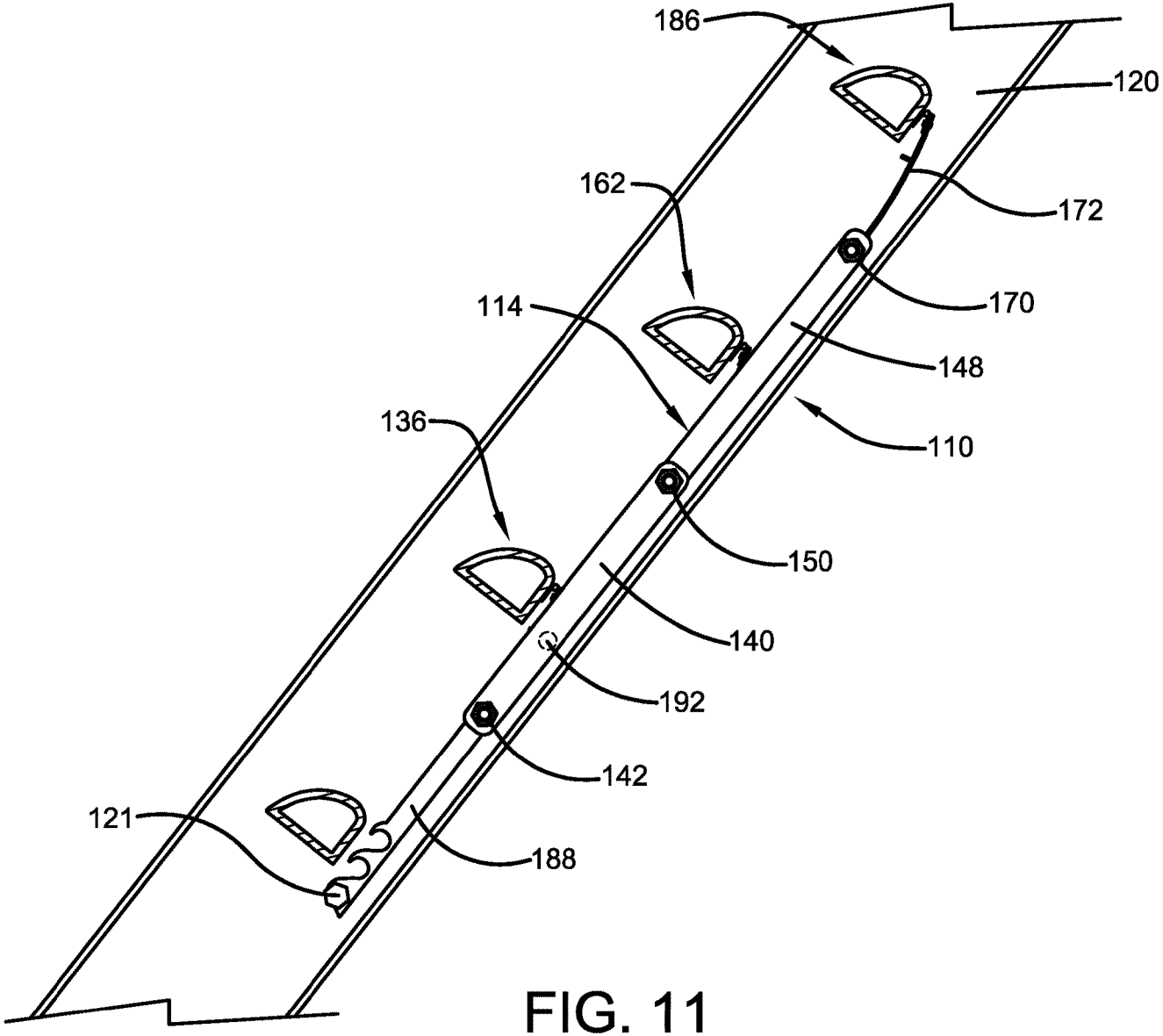
FIG. 11 is a side view of a ladder rung extension assembly of one or more embodiments of the invention coupled with an extension ladder, with the assembly in a closed position.

As shown in FIG. 11, ladder rung extension assembly 110 may be characterized as having a second position, which may also be described as a closed position or a stored position. The closed position of ladder rung extension assembly 110 is that position that corresponds with ladder rung extension assembly 110 in a downward position. Ladder rung extension assembly 110 may be secured in the downward position by a mounting bolt 121 on each leg of extension ladder 120, as shown in FIG. 11.

First rung extension 112, which may also be described as a first extension assembly 112, includes an extension portion 122 extending between a ladder securement 132, such as a hinge 132, and a pivot portion (not seen in Figures). Extension portion 122 may be any suitable planar or generally planar component for allowing a user to place his foot thereon when in a deployed position. Pivot portion, which may be described as a bracket assembly securement, may be any type of connection between extension portion 122 and bracket assembly 114 that allows ladder rung extension assembly 110 to rotate from the deployed position to the stored position, as further described herein. Ladder securement 132 may be any type of connection between extension portion 122 and ladder 120 that allows ladder rung extension assembly 110 to rotate from the deployed position to the stored position, as further described herein.

Extension portion 122 may form an upper wall with pivot portion forming a rear wall. The top side of upper wall 122 may include traction features (e.g., ridges and grooves) such as are often found in conventional ladder rungs. In one or more embodiments, the bottom side of upper wall 122 may include a tab on a portion or all of the width of upper wall 122 to provide additional strength to upper wall 122. In one or more embodiments, the tab may be in the shape of an I-beam. In one or more embodiments, the bottom side of upper wall 122 may lack a tab, if upper wall 122 otherwise has sufficient strength.

The rear wall may extend downward from an end of upper wall 122. The rear wall may be a generally semi-cylindrical shape or a semi-cylindrical shape to thereby retain a first pin (not seen in Figures) of bracket assembly 114. The rear wall may be formed with or without groove portions. The generally semi-cylindrical shape or semi-cylindrical shape of the rear wall allows the rear wall to retain the first pin of bracket assembly 114 while also allowing ladder rung extension assembly 110 to move between the first position and the second position.

Hinge portion 132 of first extension assembly 112 includes a first leaf 128 and a second leaf 130 extending laterally from a knuckle. The knuckle may include a rod inside the knuckle for holding first leaf 128 and second leaf 130 together. As generally known in the art, first leaf 128 and second leaf 130 may provide alternating, interlocking, hollow, circular portions creating the joint of the hinge through which the rod is set. Though an exemplary hinge portion 132 is shown in the Figures, other hinge portions may be generally known to those skilled in the art.

First leaf 128 is coupled with the bottom side of upper wall 122. Second leaf 130 is adapted to be coupled with ladder 120. As shown in FIG. 10, second leaf 130 may be coupled with a first side wall 134 of a first ladder rung 136. The coupling of first leaf 128 with the bottom side of upper wall 122 and the coupling of second leaf 130 with a first side wall 134 of a first ladder rung 136 may be by any coupling as generally known in the art. This may include screw and nut configurations with screws through holes within first leaf 128 and second leaf 130 and respective holes within the respective components to which they are coupled. In one or more embodiments, the coupling may be welding or another strong adhesive.

As disclosed above, the rear wall is adapted to retain the first pin of bracket assembly 114. Each end of the first pin is positioned through a first hole within a respective first bracket portion 140. A fastening mechanism 142 at each end of the first pin is adapted to secure the rear wall and first extension assembly 112 between the pair of first bracket portions 140. First extension assembly 112 is able to rotate about the first pin in order to move between the first position and the second position of ladder rung extension assembly 110. In one or more embodiments, the first pin includes threaded ends and fastening mechanism 142 includes a bolt mated with each threaded end.

As disclosed above with respect to ladder rung extension assembly 10, for one or more embodiments of ladder rung extension assembly 110, the rotation of any component with respect to a second component may be aided by the use of one or more ball bearings, as generally known to those skilled in the art. As an example, a ball bearing may be positioned between the first pin and the first hole of each first bracket portion 140.

Each first bracket portion 140 extends from first extension assembly 112 toward second extension assembly 116. Each first bracket portion 140 includes a second hole for positioning a second pin (not seen in Figures) therewithin. The second pin is adapted to secure second extension assembly 116, particularly a rear wall (not seen in Figures) thereof, between a pair of second bracket portions 148 and between the pair of first bracket portions 140. Though second bracket portions 148 are shown in an inward position on the second pin with respect to first bracket portions 140, it should be appreciated that first bracket portions 140 may be positioned inward of second bracket portions 148 in certain embodiments.

A fastening mechanism 150 at each end of the second pin (not seen in Figures) may be utilized for the securement of second extension assembly 116, second bracket portions 148, and the second pin. In one or more embodiments, the second pin includes threaded ends and fastening mechanism 150 includes a bolt mated with each threaded end. Second extension assembly 116 is able to rotate about the second pin in order to move between the first position and the second position of ladder rung extension assembly 110.

Second rung extension 116, which may also be described as a second extension assembly 116, includes an extension portion 152 extending between a ladder securement 158, such as a hinge 158, and a pivot portion (not seen in Figures). Extension portion 152 may be any suitable planar or generally planar component for allowing a user to place his foot thereon when in a deployed position. Pivot portion, which may be described as a bracket assembly securement, may be any type of connection between extension portion 152 and bracket assembly 114 that allows ladder rung extension assembly 110 to rotate from the deployed position to the stored position, as further described herein. Ladder securement 158 may be any type of connection between extension portion 152 and ladder 120 that allows ladder rung extension assembly 110 to rotate from the deployed position to the stored position, as further described herein.

Extension portion 152 may form an upper wall with pivot portion forming a rear wall. The top side of upper wall 152 may include traction features (e.g., ridges and grooves) such as are often found in conventional ladder rungs. In one or more embodiments, the bottom side of upper wall 152 may include a tab on a portion or all of the width of upper wall 152 to provide additional strength to upper wall 152. In one or more embodiments, the tab may be in the shape of an I-beam. In one or more embodiments, the bottom side of upper wall 152 may lack a tab, if upper wall 152 otherwise has sufficient strength.

The rear wall may extend downward from an end of upper wall 152. The rear wall may be a generally semi-cylindrical shape or a semi-cylindrical shape to thereby retain the second pin of bracket assembly 114. The rear wall may be formed with or without groove portions. The generally semi-cylindrical shape or semi-cylindrical shape of the rear wall allows the rear wall to retain the second pin of bracket assembly 114 while also allowing ladder rung extension assembly 110 to move between the first position and the second position.

Hinge portion 158 of second extension assembly 116 includes a first leaf 154 and a second leaf 156 extending laterally from a knuckle. The knuckle may include a rod inside the knuckle for holding first leaf 154 and second leaf 156 together. As generally known in the art, first leaf 154 and second leaf 156 may provide alternating, interlocking, hollow, circular portions creating the joint of the hinge through which the rod is set. Though an exemplary hinge portion 158 is shown in the Figures, other hinge portions may be generally known to those skilled in the art.

First leaf 154 is coupled with the bottom side of upper wall 152. Second leaf 156 is adapted to be coupled with ladder 120. As shown in FIG. 10, second leaf 156 may be coupled with a first side wall 160 of a second ladder rung 162. The coupling of first leaf 154 with the bottom side of upper wall 152 and the coupling of second leaf 156 with first side wall 160 of second ladder rung 162 may be by any coupling as generally known in the art. This may include screw and nut configurations with screws through holes within first leaf 154 and second leaf 156 and respective holes within the respective components to which they are coupled. In one or more embodiments, the coupling may be welding or another strong adhesive.

Each second bracket portion 148 extends from second extension assembly 116 toward third extension assembly 118. Each of second bracket portions 148 generally forms a straight line with the respective first bracket portion 140. Each second bracket portion 148 includes a second hole for positioning a third pin (not seen in Figures) therewithin. The third pin is adapted to secure third extension assembly 118, particularly a rear wall thereof, between the pair of second bracket portions 148. A fastening mechanism 170 at each end of the third pin may be utilized for the securement of second bracket portions 148 and the third pin. In one or more embodiments, the third pin includes threaded ends and fastening mechanism 170 includes a bolt mated with each threaded end. Third extension assembly 118 is able to rotate about the third pin in order to move between the first position and the second position of ladder rung extension assembly 110.

Third rung extension 118, which may also be described as a third extension assembly 118, includes an extension portion and a hinge portion, includes an extension portion 172 extending between a ladder securement 182, such as a hinge 182, and a pivot portion (not seen in Figures). Extension portion 172 may be any suitable planar or generally planar component for allowing a user to place his foot thereon when in a deployed position. Pivot portion, which may be described as a bracket assembly securement, may be any type of connection between extension portion 172 and bracket assembly 114 that allows ladder rung extension assembly 110 to rotate from the deployed position to the stored position, as further described herein. Ladder securement 182 may be any type of connection between extension portion 172 and ladder 120 that allows ladder rung extension assembly 110 to rotate from the deployed position to the stored position, as further described herein.

Extension portion 172 may form an upper wall with pivot portion forming a rear wall. The top side of upper wall 172 may include traction features (e.g., ridges and grooves) such as are often found in conventional ladder rungs. In one or more embodiments, the bottom side of upper wall 172 may include a tab on a portion or all of the width of upper wall 172 to provide additional strength to upper wall 172. In one or more embodiments, the tab may be in the shape of an I-beam. In one or more embodiments, the bottom side of upper wall 172 may lack a tab, if upper wall 172 otherwise has sufficient strength.

The rear wall may extend downward from an end of upper wall 172. The rear wall may be a generally semi-cylindrical shape or a semi-cylindrical shape to thereby retain the second pin of bracket assembly 114. The rear wall may be formed with or without groove portions. The generally semi-cylindrical shape or semi-cylindrical shape of the rear wall allows the rear wall to retain the second pin of bracket assembly 114 while also allowing ladder rung extension assembly 110 to move between the first position and the second position.

Hinge portion 182 of second extension assembly 116 includes a first leaf 178 and a second leaf 180 extending laterally from a knuckle. The knuckle may include a rod inside the knuckle for holding first leaf 178 and second leaf 180 together. As generally known in the art, first leaf 178 and second leaf 180 may provide alternating, interlocking, hollow, circular portions creating the joint of the hinge through which the rod is set. Though an exemplary hinge portion 182 is shown in the Figures, other hinge portions may be generally known to those skilled in the art.

First leaf 178 is coupled with the bottom side of upper wall 172. Second leaf 180 is adapted to be coupled with ladder 120. As shown in FIG. 10, second leaf 180 may be coupled with a first side wall 184 of a third ladder rung 186. The coupling of first leaf 178 with the bottom side of upper wall 172 and the coupling of second leaf 180 with first side wall 184 of a third ladder rung 186 may be by any coupling as generally known in the art. This may include screw and nut configurations with screws through holes within first leaf 178 and second leaf 180 and respective holes within the respective components to which they are coupled. In one or more embodiments, the coupling may be welding or another strong adhesive.

As mentioned above, bracket assembly 114 includes a pair of downward extending bracket portions 188. Downward extending bracket portions 188 extend from first extension assembly 112 toward securing features for securing ladder rung extension assembly 110 in the open position and the closed position.

For securing ladder rung extension assembly 110 in the open position, downward extending bracket portions 188 include one or more grooves 190 adapted to fit over a securing pin 192 mounted in each leg of ladder 120. Ladder rung extension assembly 110 is rotatable about each hinge portion such that a desired groove 190 may be lifted above securing pin 192. Then, ladder rung extension assembly 110 is lowered such that the desired groove 190 contacts securing pin 192 to prevent further downward travel of the desired groove 190 and ladder rung extension assembly 110. The gravity force of ladder rung extension assembly 110 will keep the desired groove 190 secured on pin 192.

To move ladder rung extension assembly 110 to the closed position, ladder rung extension assembly 110 can be raised to lift the desired groove 190 from pin 192. Then ladder rung extension assembly 110 can be fully lowered, as shown in FIG. 11, based on the rotation about the hinge portions. Once in the fully lowered position, a securing bolt 121 can be tightened against each downward extending bracket portion 188 to keep ladder rung extension assembly 110 in the closed position. This process of moving to the closed position may include removal of securing bolt 121 during the transition from open position to closed position, with re-insertion of securing bolt 121 to secure ladder rung extension assembly 110 in the closed position. To move ladder rung extension assembly 110 back to the open position, securing bolt 121 is removed or loosened, and ladder rung extension assembly 110 is raised upward and the desired groove 190 is again secured on pin 192.

When in the closed position, the respective components of ladder rung extension assembly 110 avoid interference with the ability of extension ladder 120 to extend inward and outward. Thus, ladder rung extension assembly 110 may be placed on an existing conventional extension ladder, that is, subsequent to the manufacture and purchase of the conventional extension ladder, without modification to the conventional extension ladder other than steps necessary for the addition of ladder rung extension assembly 110. In other embodiments, ladder rung extension assembly 110 may be placed on an extension ladder as part of the manufacturing process.

Downward extending bracket portion 188 is of a length and pin 192 is at a position as to allow the open position of ladder rung extension assembly 110 to be suitable for a user to utilize the extension assemblies. That is, the upper walls of the extension assemblies should be parallel or generally parallel with the ladder rungs when ladder rung extension assembly 110 is in the open position. This will ensure a user can comfortably stand on ladder rung extension assembly 110.

As generally known to those skilled in the art, components of ladder rung extension assembly 110 may be made be made of any suitable material. Exemplary materials include metal, wood, fiberglass, and tough plastic. In one or more embodiments, all components of ladder rung extension assembly 110 are metal. In other embodiments, different components of ladder rung extension assembly 110 may be made from different materials.

For adding ladder rung extension assembly 110 to ladder 120, certain steps may be taken to ease the addition. For example, as disclosed above, one or more embodiments include screw and nut configurations to secure the second leaf of a hinge portion with a ladder rung. Thus, the addition of ladder rung extension assembly 110 to ladder 120 may benefit from providing pilot holes within the first side walls of the ladder rungs. Where a user may add ladder rung extension assembly 110 to an already-purchased ladder 120, ladder rung extension assembly 110 may be accompanied with particular instructions for drilling pilot holes in predetermined locations. Or, the pilot holes may be drilled by the user as desired for a particular type of ladder 120.

In connection with use on ladder 120, first extension assembly 112 is adapted to serve the function of extending the depth of first ladder rung 136 such that a user may stand more comfortably on the combination of first extension assembly 112 and first ladder rung 136. Similarly, second extension assembly 116 is adapted to serve the function of extending the depth of second ladder rung 162 and third extension assembly 118 is adapted to serve the function of extending the depth of third ladder rung 186.

In light of the foregoing, it should be appreciated that the present invention advances the art by providing an assembly to extend the depth of one or more rungs of a ladder. While particular embodiments of the invention have been disclosed in detail herein, it should be appreciated that the invention is not limited thereto or thereby inasmuch as variations on the invention herein will be readily appreciated by those of ordinary skill in the art. The scope of the invention shall be appreciated from the claims that follow.

What is claimed is:

1. A ladder rung extension assembly comprising a bracket assembly including a first pin, a second pin, a pair of mounting assemblies, a pair of first bracket portions extending between the first pin and the second pin, and a pair of angled bracket portions, each of the angled bracket portions extending between the second pin and a respective mounting assembly of the pair of mounting assemblies, each of the angled bracket portions including a respective hole for receiving a mounting assembly pin therein such that the pair of angled bracket portions are rotatable about the mounting assembly pin, the mounting assembly pin extending between the pair of angled bracket portions and the pair of mounting assemblies, a first rung extension assembly having a pivot portion rotatable about the first pin, and a second rung extension assembly having a pivot portion rotatable about the second pin, the first rung extension assembly including a planar upper wall, wherein the pivot portion of the first rung extension assembly is formed as a rear wall extending downward from the planar upper wall of the first rung extension assembly, the rear wall of the first rung extension assembly being generally semi-cylindrically shaped to thereby retain the first pin, the second rung extension assembly including a planar upper wall, wherein the pivot portion of the second rung extension assembly is formed as a rear wall extending downward from the planar upper wall of the second rung extension assembly, the rear wall of the second rung extension assembly being generally semi-cylindrically shaped to thereby retain the second pin;

the planar upper wall of the first rung extension assembly having a bottom surface, the first rung extension assembly further comprising a first hinge, the first hinge having a first leaf and a second leaf, the first leaf of the first hinge being coupled with the bottom surface of the planar upper wall of the first rung extension assembly, the second leaf of the first hinge being adapted to be coupled with an end of a first ladder rung of a ladder, the planar upper wall of the second rung extension assembly having a bottom surface, the second rung extension assembly further comprising a second hinge, the second hinge having a first leaf and a second leaf, the first leaf of the second hinge being coupled with the bottom surface of the planar upper wall of the second rung extension assembly, the second leaf of the second hinge being adapted to be coupled with an end of a second ladder rung of a ladder, wherein the first rung extension assembly does not overlap a top surface of the first ladder rung when coupled with the end of the first ladder rung, and wherein the second rung extension assembly does not overlap a top surface of the second ladder rung when coupled with the end of the second ladder rung.

2. The ladder rung extension assembly of claim 1, the bracket assembly further including a third pin and a pair of second bracket portions extending between the second pin and the third pin, the ladder rung extension assembly further comprising a third rung extension assembly rotatable about the third pin.

3. The ladder rung extension assembly of claim 2, the third rung extension assembly including a planar upper wall and a rear wall extending downward from the upper wall of the third rung extension assembly, the rear wall of the third rung extension assembly being generally semi-cylindrically shaped to thereby retain the third pin.

4. The ladder rung extension assembly of claim 2, the third rung extension assembly including a planar lower wall and a rear wall extending upward from the lower wall of the third rung extension assembly, the rear wall of the third rung extension assembly being generally semi-cylindrically shaped to thereby retain the third pin.

5. The ladder rung extension assembly of claim 4, the planar lower wall of the third rung extension assembly having a bottom surface and a top surface, the bottom surface of the third rung extension assembly having one or more magnets coupled therewith to thereby retain one or more magnetic work pieces on the top surface of the planar lower wall of the third rung extension assembly.

6. The ladder rung extension assembly of claim 2, the ladder rung extension assembly being coupled with a ladder, the ladder having a deployed position when in use by a user and a stored positioned when not in use by a user, the ladder rung extension assembly having an open position corresponding to the ladder in the deployed position, and a closed position corresponding to the ladder in the stored position, wherein movement of the ladder between the deployed position and the stored position occurs without interference from the ladder rung extension assembly, each of the angled bracket portions forming an angle with respect to a respective first bracket portion of the pair of first bracket portions when the ladder rung extension assembly is positioned in the open position, wherein the angle is in a range of from 110 degrees to 140 degrees.

7. The ladder rung extension assembly and the ladder of claim 6, wherein the angle is in a range of from 120 degrees to 130 degrees.

8. An A-frame ladder having one or more depth-extended rungs comprising a first pair of ladder legs, a second pair of ladder legs each having an inner surface, a first ladder rung positioned between the first pair of ladder legs, a second ladder rung positioned between the first pair of ladder legs and above the first ladder rung, and a ladder rung extension assembly, the ladder rung extension assembly including a bracket assembly including a first pin, a second pin, a pair of mounting assemblies, a pair of first bracket portions extending linearly between the first pin and the second pin, and a pair of angled bracket portions extending between the second pin and a respective mounting assembly of the pair of mounting assemblies, each of the angled bracket portions including a respective hole for receiving a mounting assembly pin therein such that the pair of angled bracket portions are rotatable about the mounting assembly pin, the mounting assembly pin extending between the pair of angled bracket portions and the pair of mounting assemblies, wherein each mounting assembly of the pair of mounting assemblies is coupled with a respective inner surface of the second pair of ladder legs, a first rung extension assembly having a first extension portion positioned between a first ladder securement securing the first rung extension assembly with the first ladder rung and a first pivot portion adapted to rotate the ladder rung extension assembly, and a second rung extension assembly having a second extension portion positioned between a second ladder securement securing the second rung extension assembly with the second ladder rung and a second pivot portion adapted to rotate the ladder rung extension assembly, the first ladder rung having an end and a top surface, the second ladder rung having an end and a top surface, wherein the first extension portion is a planar upper wall having a bottom surface and the first pivot portion is formed as a rear wall extending downward from the upper wall of the first rung extension assembly, the rear wall of the first rung extension assembly being generally semi-cylindrically shaped to thereby retain the first pin, wherein the first ladder securement is a first hinge, the first hinge having a first leaf and a second leaf, the first leaf of the first hinge being coupled with the bottom surface of the planar upper wall of the first rung extension assembly, the second leaf of the first hinge being coupled with the end of the first ladder rung, wherein the second extension portion is a planar upper wall having a bottom surface and the second pivot portion is formed as a rear wall extending downward from the upper wall of the second rung extension assembly, the rear wall of the second rung extension assembly being generally semi-cylindrically shaped to thereby retain the second pin, wherein the second ladder securement is a second hinge, the second hinge having a first leaf and a second leaf, the first leaf of the second hinge being coupled with the bottom surface of the planar upper wall of the second rung extension assembly, the second leaf of the second hinge being coupled with the end of the second ladder rung, wherein the first extension portion does not overlap the top surface of the first ladder rung, and wherein the second extension portion does not overlap the top surface of the second ladder rung.

9. The ladder of claim 8, the ladder having an open position and a closed position, each of the angled bracket portions forming an angle with respect to a respective first bracket portion of the pair of first bracket portions when the ladder is positioned in the open position, wherein the angle is in a range of from 110 degrees to 140 degrees, wherein, in the closed position, the pair of first bracket portions are parallel with the first pair of ladder legs and the second pair of ladder legs.

10. The ladder of claim 9, wherein the angle is about 125 degrees.

11. The ladder of claim 9, wherein the coupling of each mounting assembly with the respective ladder leg of the second pair of ladder legs is a fixed attachment, wherein the securing of the first rung extension assembly with the first ladder rung is a fixed attachment, and wherein the securing of the second rung extension assembly with the second ladder rung is a fixed attachment.

12. The ladder of claim 11, wherein each of the fixed attachments is a screw and nut configuration.

13. The ladder of claim 11, wherein movement of the ladder between the open position and the closed position occurs without interference from the ladder rung extension assembly on the first pair of ladder legs and the second pair of ladder legs.

14. A ladder rung extension assembly comprising a bracket assembly including a first pin, a second pin, a pair of first bracket portions extending linearly between the first pin and the second pin, a pair of downward extending bracket portions extending linearly downward from the first pin, each of the downward extending bracket portions of the pair of downward extending bracket portions including one or more grooves adapted to fit over a securing pin mounted in a leg of a ladder, a first rung extension assembly having a pivot portion rotatable about the first pin, a planar upper wall having a bottom surface, and a first hinge, the first hinge having a first leaf and a second leaf, the first leaf of the first hinge being coupled with the bottom surface of the planar upper wall of the first rung extension assembly, the second leaf of the first hinge adapted to be coupled with an end of a first ladder rung of the ladder, wherein the planar upper wall of the first rung extension assembly does not overlap a top surface of the first ladder rung when the second leaf of the first hinge is coupled with the end of the first ladder rung, and a second rung extension assembly having a pivot portion rotatable about the second pin, a planar upper wall having a bottom surface, and a second hinge, the second hinge having a first leaf and a second leaf, the first leaf of the second hinge being coupled with the bottom surface of the planar upper wall of the second rung extension assembly, the second leaf of the second hinge adapted to be coupled with an end of a second ladder rung of the ladder, wherein the planar upper wall of the second rung extension assembly does not overlap a top surface of the second ladder rung when the second leaf of the second hinge is coupled with the end of the second ladder rung.

15. The ladder rung extension assembly of claim 14, the bracket assembly further including a third pin, a pair of second bracket portions extending linearly between the second pin and the third pin, the ladder rung extension assembly further comprising a third rung extension assembly having a pivot portion rotatable about the third pin, a planar upper wall having a bottom surface, and a third hinge, the third hinge having a first leaf and a second leaf, the first leaf of the third hinge being coupled with the bottom surface of the planar upper wall of the third rung extension assembly, the second leaf of the third hinge adapted to be coupled with an end of a third ladder rung of the ladder, wherein the planar upper wall of the third rung extension assembly does not overlap a top surface of the third ladder rung when the second leaf of the third hinge is coupled with the end of the third ladder rung.

16. The ladder rung extension assembly of claim 15, wherein the pivot portion of the first rung extension assembly is a rear wall extending downward from the planar upper wall of the first rung extension assembly, the rear wall of the first rung extension assembly being generally semi-cylindrically shaped to thereby retain the first pin, wherein the pivot portion of the second rung extension assembly is a rear wall extending downward from the upper wall of the second rung extension assembly, the rear wall of the second rung extension assembly being generally semi-cylindrically shaped to thereby retain the second pin, and wherein the pivot portion of the third rung extension assembly is a rear wall extending downward from the upper wall of the third rung extension assembly, the rear wall of the third rung extension assembly being generally semi-cylindrically shaped to thereby retain the third pin.

* * * * *